United States Patent [19]

Jones, III

[11] Patent Number: 4,667,478

[45] Date of Patent: May 26, 1987

[54] APPARATUS AND METHOD FOR THE CRYOGENIC TREATMENT AND HEATING OF MATERIALS

[75] Inventor: Robert H. Jones, III, Lafayette, La.

[73] Assignee: Durotech Corporation, Lafayette, La.

[21] Appl. No.: 652,621

[22] Filed: Sep. 18, 1984

[51] Int. Cl.[4] ..... F25D 17/02

[52] U.S. Cl. ..... 62/64; 62/55; 62/100; 62/268; 62/514 R

[58] Field of Search ..... 62/50, 51, 55, 54, 514 R, 62/100, 268, 64

[56] References Cited

U.S. PATENT DOCUMENTS

| | | | |
|---|---|---|---|
| 2,406,540 | 8/1946 | Harrington | 62/54 |
| 2,502,525 | 4/1950 | Krugler | 62/55 |
| 2,854,826 | 10/1958 | Johnston | 62/55 |
| 2,856,160 | 10/1958 | Kaye et al. | 62/50 |
| 2,964,916 | 12/1960 | Keeping | 62/55 |
| 3,007,319 | 11/1961 | Ogden | 62/55 |
| 3,350,229 | 10/1967 | Justi | 62/50 |
| 3,456,451 | 7/1969 | Roberson, Jr. | 62/55 |
| 3,946,572 | 3/1976 | Bragg | 62/50 |
| 4,175,395 | 11/1979 | Prost et al. | 62/55 |
| 4,198,828 | 4/1980 | Mercier et al. | 62/55 |

*Primary Examiner*—Ronald C. Capossela

*Attorney, Agent, or Firm*—Mason, Fenwick & Lawrence

[57] ABSTRACT

The apparatus comprises an insulated storage tank adapted to hold a liquified cryogenic fluid and vapor emanating from the liquified cryogenic fluid, an insulated working chamber adapted to hold an object to be treated, and a vacuum pump for evacuating the interior of the working chamber. The storage tank is in fluid communication with the working chamber, either directly, or through a vapor reservoir adapted to hold the vapor emanating from the cryogenic fluid. The method comprises introducing the vapor and/or liquid cryogen into the working chamber either in discrete or continuous amounts. The working chamber can be evacuated to a specific negative pressure either prior to introducing the vapor and/or liquid cryogen or simultaneously as the cryogens are introduced. The apparatus also provides the capability of heating materials from cryogenic levels to room-or-higher-temperature levels in a choice of ambient gases.

48 Claims, 4 Drawing Figures

APPARATUS AND METHOD FOR THE CRYOGENIC TREATMENT AND HEATING OF MATERIALS

BACKGROUND OF THE INVENTION

The present invention is directed to the field of cryogenic cooling and is more specifically directed to apparatus and a method for cryogenically cooling materials in which temperatures can be decreased or increased continuously or in incremental steps while maintaining very low temperature gradients throughout the chamber in which the materials are treated.

Materials exposed to cryogenic temperatures show improvement in wear resistance. Commercial systems for cryogenic processing generally employ one of two methods: either exposing materials to vapors emanating from cold liquified gases, or cryogens, at or near standard pressure conditions for a predetermined time, or exposing materials to liquid-gas vapors and slowly lowering the items into the liquid gas itself at or near standard pressure conditions. Both types of systems have proven very successful, but have disadvantages. For example, when treating a material in vapors above a cryogenic liquid, a large thermal gradient between the vapor and liquid cryogen can exist. When a material is pre-cooled in a vapor and then lowered into the cryogenic liquid, an added disadvantage exists, in that the lower portion of the material enters the liquid-gas phase while the upper portion is still in the vapor phase. This creates some distortion within the material because of the temperature gradient between the upper-level vapor and the vapor-liquid interface.

Most commercial systems for cryogenic processing generally use liquid nitrogen for vapor treatment and liquid-gas immersion. Thus, the minimum temperature the material can be exposed to at standard pressure conditions is about −320° F., the boiling point of nitrogen at standard pressure. If some other cryogen is used, the minimum temperature attained will also be that of its boiling point at standard pressure conditions. The ability of most commercial systems to control temperatures within thermal-fracture or distortion threshholds is also questionable. When treating a material in a cryogenic vapor or liquid at standard pressures or higher, the cooling capability of the cryogen is limited by the following factors:

(1) for an open system, the maximum heat absorption of the vapor cryogen is limited by the maximum expansion temperature of the vapor, which will be determined by the mass and temperature of its external surroundings and the boiling point of the liquid cryogen at standard pressure;

(2) for a closed system, maximum heat absorption of the cryogen will be limited by the maximum temperature obtained, which in turn is limited by the higher pressure within the closed system. The minimum temperature which can be obtained within such a closed system is that of the liquid cryogen's boiling point, which will be a higher temperature than the boiling point at standard pressure.

It is the solution of these problems to which the present invention is directed.

SUMMARY OF THE INVENTION

Therefore, it is the primary object of this invention to provide a new and improved apparatus and method for cryogenically treating materials in which temperatures can be decreased or increased continuously or in incremental steps while maintaining very low temperature gradients throughout the chamber in which the materials are treated.

It is another object of the invention to provide an apparatus and method for cryogenically treating materials both below the boiling point of the cryogen used as a refrigerant in the system and also below the freezing point of the cryogen.

It is another object of this invention to provide an apparatus and method for cryogenically treating materials which offer a choice of ambients in which the materials can be treated either to or from cryogenic temperature levels.

It is still another object of this invention to provide an apparatus and method for cryogenically treating both metallic and non-metallic materials, including such non-metallic materials as plastic, nylon, polypropalene, polyurethane, plexiglas, glass, and food.

The foregoing objects are achieved by provision of apparatus for the cryogenic treatment of materials comprising a cryogenic storage tank, a vapor reservoir in fluid communication with the cryogenic storage tank, an insulated working chamber in fluid communication with the vapor reservoir, and a vacuum pump in fluid communication with the working chamber. The cryogenic storage tank holds a liquid cryogen, the vapor reservoir holds the vapor from the liquid cryogen fluid, and the working chamber holds the object to be treated. The vacuum pump evacuates the interior of the working chamber and can also evacuate the interior of the vapor reservoir, where required.

In one aspect of the invention, the working chamber is also in direct fluid communication with the cryogenic storage tank. In another aspect of the invention, pressure release valves are associated with the working chamber, the vapor reservoir, and the storage tank, and are adapted to allow vapor expansion to specified pressures in the working chamber, the vapor reservoir, and the storage tank, respectively. In yet another aspect of the invention, radiant heaters or vapor dispersion tubes or both can be placed in the interior of the working chamber.

The foregoing objects can also be achieved by a method for cryogenically treating materials comprising introducing a small amount of cryogen vapor or liquid into a relatively large chamber and then repeatedly evacuating the chamber to lower pressures and introducing additional amounts of cryogen vapor or liquid. Alternatively, the foregoing objects can be achieved by a method for cryogenically treating materials comprising simultaneously evacuating the chamber and introducing cryogen vapor or liquid into the chamber at constant rates.

DESCRIPTION OF THE PREFERRED EMBODIMENTS

Figure 1:
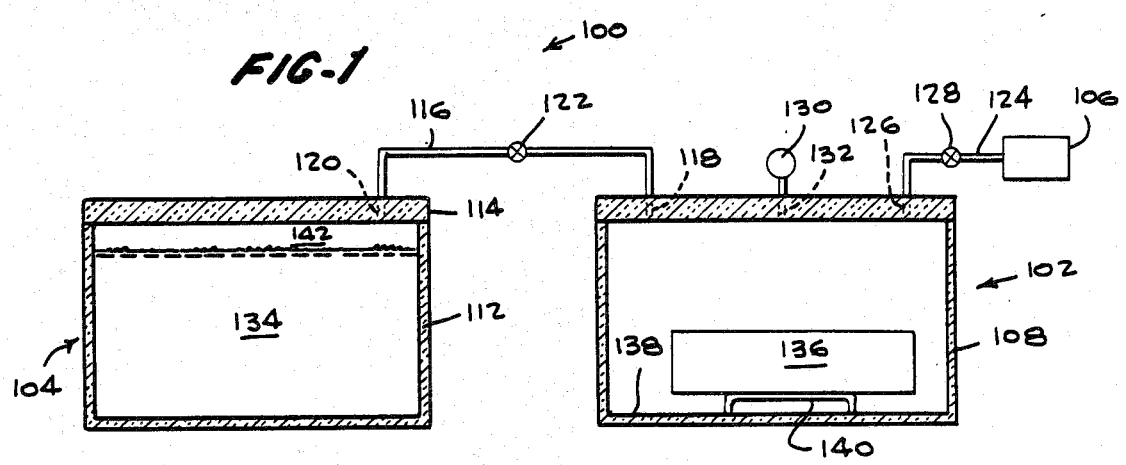
FIG. 1 is a diagramatic view of a first embodiment of the invention.

Referring to FIG. 1, there is illustrated cryogenic apparatus according to the invention generally designated by reference numeral 100. Cryogenic apparatus 100 comprises cryogenic working chamber 102, storage tank 104, and vacuum pump 106. Although working chamber 102 is illustrated as rectangular, its size, shape, and construction can be varied according to the size and shape of the material being treated. Working chamber 102 can be constructed of any material capable of withstanding cryogenic temperatures and high vacuums, for example certain metals and recently developed plastics. Low carbon, nickel-chromium stainless steels are preferable if a metal is used.

Generally, a commercially available mechanical pump can be used for vacuum pump 106. However, if extremely low temperatures (near absolute zero) are to be attained, a diffusion pump capable of pumping to pressures of $10^{-6}$ Torr or lower may be required. This type of pump is also commercially available.

Working chamber 102 is lined with insulation 108 and has a lid 110. Storage tank 104 is also lined with insulation 112 and has a lid 114. The interiors of working chamber 102 and storage tank 104 are connected by a vacuum hose or conduit 116 inserted through holes 118 and 120 in working chamber lid 110 and storage tank lid 114, respectively. A valve 122 is inserted in vacuum hose 116 for a purpose to be described hereinafter. Working chamber 102 and vacuum pump 106 are connected by a vacuum line 124 inserted through another hole 126 in working-chamber lid 110. A valve 128 is inserted in line 124 for a purpose also to be described hereinafter. A temperature sensor 130 for monitoring the temperature inside working chamber 102 is also inserted through working-chamber lid 110 through a hole 132.

In use, storage tank 104 is partially filled with a liquid cryogen 134, such as liquid nitrogen, at a pressure greater than one atmosphere. Other liquid cryogens, for example liquid helium, can also be used. Preferably, the pressure in storage tank 104 is in the range of approximately 40 to 200 psi. A cryogen vapor 142 emanates from liquid cryogen 134 into the space above the surface 144 of liquid cryogen 134. An object, such as steel block 136, is placed in working chamber 102. Steel block 136 is suspended above the floor 138 of working chamber 102 by a support 140. Lid 110 of working chamber 102 is closed and vacuum pump 106 is turned on.

In this embodiment of the invention, the cryogen vapor 142 can be introduced into working chamber 102 in continuous amounts, without evacuation of working chamber 102, or it can be introduced into working chamber 102 simultaneously with its evacuation.

The first method for cooling material in working chamber 102 comprises continuously introducing cryogen vapor 142 into working chamber 102. Continuous amounts of cryogen vapor 142 can be introduced into working chamber 102 by opening valve 122 in line 116 between working chamber 102 and storage tank 104. Valve 122 can be adjusted to permit either a high or low flow rate, depending upon the desired temperature-reduction rate. Valve 128 between working chamber 102 and vacuum pump 106 remains closed, so that working chamber 102 is not evacuated. The temperature-reduction rate will depend on the thermal-fracture and distortion threshholds of the material being treated and of the inside of working chamber 102. The minimum temperature which can be reached in working chamber 102 is limited by the temperature of the cryogen vapor 142, which in turn depends upon the pressure of the cryogen vapor 142. Since the pressure will be higher than one atmosphere, the lowest possible temperature will be greater than the boiling point of the cryogen at one atmosphere.

In the second method, cryogen vapor 142 is introduced into working chamber 102 while working chamber 102 is simultaneously evacuated. Valves 122 and 128 are opened simultaneously and adjusted to provide constant rates of vapor flow from storage tank 104 to working chamber 102 and a constant rate of evacuation of working chamber 102. Either a high or a low negative pressure can be used in working chamber 102. The minimum temperature that can be reached in working chamber 102 using this method is below the standard-pressure boiling point but above the freezing point of the cryogen at one atmosphere.

When the desired temperature level is reached using any of these methods, the temperature level can be sustained by introducing small amounts of cryogen vapor 142 into working chamber 102 at periodic intervals while maintaining a vacuum in working chamber 102.

Figure 2:
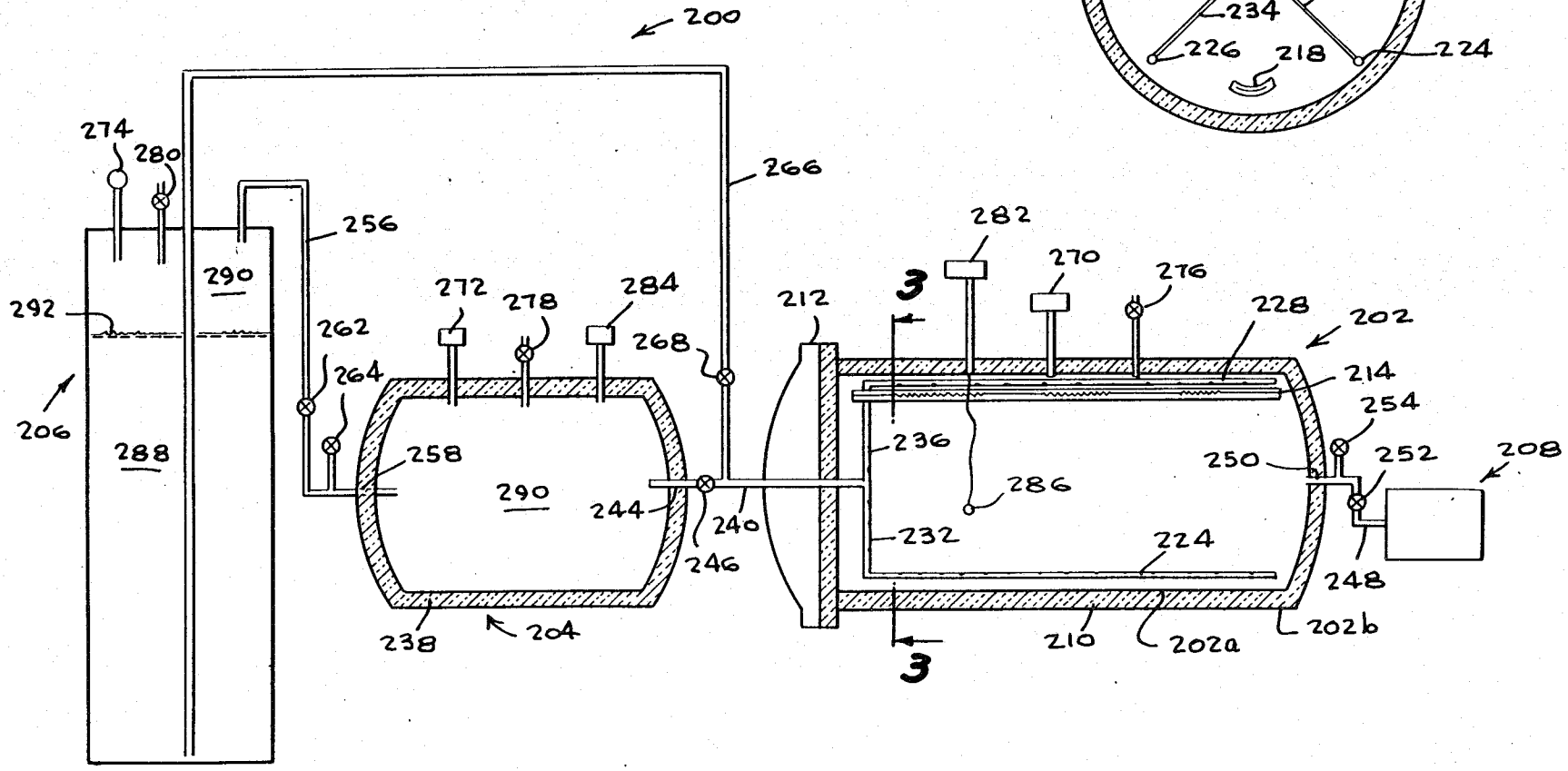
FIG. 2 is a diagramatic view of a second embodiment of the invention.

After the material in working chamber 102 has been treated for the desired length of time at cryogenic temperature levels, the material can be warmed back to room temperature either in a vacuum or in any desired ambient, either by introducing warmer external vapors into working chamber 102 or by using radiant heaters, such as heaters 214–220 illustrated in FIG. 2. The material can also be heated to temperatures higher than room temperature, for example, for stress-relief heating, by using radiant heaters. Heating to higher than room temperature levels also can be done either in a vacuum or in any desired ambient. During heating, the thermal-fracture and distortion threshholds of the material must not be exceeded. If the material is heated to higher-than-room-temperature levels, it can be cooled back to room temperature either in a vacuum or in cooler external vapors introduced into working chamber 102. The thermal-fracture and distortion rates also must not be exceeded during cooling.

Figure 3:
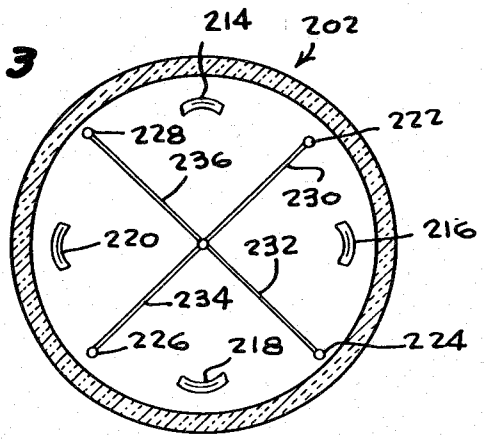
FIG. 3 is a diagramatic view of a cross-section of the invention of FIG. 2 taken along line 3—3.

Referring now to FIGS. 2 and 3, there is illustrated another cryogenic apparatus according to the invention, generally designated by reference numeral 200. Cryogenic apparatus 200 comprises a cylindrical cryogenic working chamber 202 having inner and outer walls **202*a* and 202*b*, a vapor reservoir 204, an insulated cryogenic storage tank 206, and a vacuum pump 208. Although working chamber 202 is illustrated as cylindrical, its size, shape, and construction can be varied according to the size and shape of the material being treated. Also, the material used in the construction of inner and outer walls 202*a* and 202*b* can be varied depending upon the size and shape of the materials to be treated and the maximum and minimum temperatures to be attained. Generally, the larger and heavier the materials to be treated, the thicker inner and outer walls 202*a* and 202*b* must be. Likewise, the lower the temperatures (and therefore the higher the vacuums) to be attained, the thicker inner wall 202*a* must be. Working chamber 202** can be constructed of any material capable of withstanding cryogenic temperatures and high vacuums, for example certain metals and recently-developed plastics.

Low-carbon, nickel-chromium stainless steels are preferable if a metal is used. In a preferred embodiment, working chamber 202 is 5.5 feet long, has an inside diameter of 1.5 feet, and is constructed of type 304 stainless steel. This construction is of sufficient strength to hold items weighing up to 1500 lbs.

Generally, a commercially available mechanical pump can be used for vacuum pump 208. However, if extremely low temperatures (near absolute zero) are to be attained, a commercially available diffusion pump capable of pumping to pressures of $10^{-6}$ Torr or lower may be required. In a preferred embodiment, a pump capable of pumping to a pressure of one micron at a rate of 20 CFM is used.

The outside of inner wall 202*a* is wrapped with insulation 210, for example, fiberglass tissue and foil. In the apparatus illustrated, a door 212 is located at one end of working chamber 202. Alternatively, door 212 can instead be located at the top of working chamber 202 to allow use of a hoist to load heavy items.

Working chamber 202 can include parallel, spaced-apart radiant heaters 214, 216, 218 and 220. As shown in FIG. 3, heaters 214–220 are preferably located circumferentially, parallel to the chamber side alongside inner wall 202*a*, and extend substantially the length of working chamber 202. In the apparatus illustrated, there are four heaters, each approximately 90° from the next. Separate heat-treating apparatus can be used instead of radiant heaters 214–220, for material requiring heat treatment. Heaters 214–220 serve two purposes. First, they can be used to heat the material being treated to room temperature after it has been treated at cryogenic temperature levels. Second, they can be used to heat the material being treated to higher-than-room temperature, for example at levels in the range of approximately 300°–600° F. for stress relief after the material has been treated at cryogenic temperature levels.

As also shown in FIG. 3, working chamber 202 can also include parallel, spaced-apart vapor dispersion tubes 222, 224, 226 and 228 connected respectively by intersecting arms 230, 232, 234 and 236. Preferably, vapor dispersion tubes 222–228 are also located circumferentially as shown in FIG. 3 parallel to the chamber side, and extend substantially the length of working chamber 202, and are interposed between radiant heaters 214–220. In the apparatus illustrated, there are four vapor dispersion tubes, each approximately 90° from the next. Opposite vapor dispersion tubes 222 and 226 are connected respectively to arms 230 and 234, and opposite vapor dispersion tubes 224 and 228 are connected respectively to arms 232 and 236. The purpose of vapor dispersion tubes 222–228 is to enhance the temperature uniformity throughout working chamber 202. Vapor dispersion tubes 222–228 are perforated to permit uniform dispersion of the cryogen vapor in working chamber 202. The size and number of perforations in the tubes can be varied as required to obtain uniform distribution of the vapor depending on the weight per unit length of the material being treated. Vapor dispersion tubes 222–228 need not be used if very small temperature variations are not required.

The outside of the inner wall of vapor reservoir 204 is lined with insulation 238, for example fiberglass tissue and foil. The interiors of working chamber 202 and vapor reservoir 204 are connected by a vacuum line 240 inserted through hole 242 in door 212 of working chamber 202 and a hole 244 in the wall of vapor reservoir 204. Where vapor dispersion tubes 222–228 are used, as in the apparatus illustrated, vacuum line 240 is connected to arms 230–236 at their intersection. Line 240 includes a valve 246 for controlling the flow of vapor to working chamber 202.

The interior of working chamber 202 and vacuum pump 208 are connected by a vacuum line 248 inserted through a hole 250 through walls of 202*a* and 202*b* of working chamber 202. Line 248 includes a vacuum pump valve 252 and a vacuum release valve 254. Vacuum release valve 254 can be used as an entry port to allow gases or vapors other than the cryogenic-treating vapor to be introduced into working chamber 202 to return the material being heated to room temperature or to heat it above room temperature, as will be described in greater detail hereinafter.

The interiors of vapor reservoir 204 and storage tank 206 are connected by a line 256 inserted through holes 258 and 260 in the walls of vapor reservoir 204 and storage tank 206, respectively. Line 256 includes a valve 262 for controlling the flow of cryogen vapor to vapor reservoir 204 and a vacuum release valve 264 for a purpose to be described hereinafter.

The interior of storage tank 206 is also connected directly to the interior of working chamber 202 directly by a line 266. Line 266 extends to the bottom of storage tank 206 for drawing liquid cryogen 288 from storage tank 206. Line 266 includes a valve 268 for controlling the flow of liquid cryogen to working chamber 202.

Pressure indicators 270, 272 and 274 and pressure release valves 276, 278 and 280 are inserted respectively through the walls of working chamber 202, vapor reservoir 204, and storage tank 206. Pressure release valves 276, 278 and 280 allow vapor expansion to specific pressures, as well as serving a safety function. Also, temperature indicators 282 and 284 are inserted respectively through the walls of working chamber 202 and vapor reservoir 204. Temperature indicator 282 is connected to a temperature sensor 286 located within working chamber 202. If, after cooling to cryogenic temperature levels, the material is to be heated no higher than 100° F., a silicon diode sensor can be used. If the material is to be heated higher than 100° F., then a platinum-rhodium thermocouple is used.

In use, storage tank 206 is partially filled with a liquid cryogen 288, such as liquid nitrogen, at a pressure greater than one atmosphere. Preferably the pressure in storage tank 206 is in the range of approximately 40–200 psi. Other liquid cryogens, for example liquid helium, can also be used. A cryogen vapor 290 emanates from liquid cryogen 288 into the space above the surface 292 of liquid cryogen 288. An object 294 is placed in working chamber 202 and suspended above the floor of working chamber 202 by a support (also not shown). Door 212 of working chamber 202 is closed and vacuum pump 208 is turned on.

In this embodiment of the invention, the cryogen vapor 290 can be introduced into working chamber 202 via vapor reservior 204 either in continuous or discrete amounts, with or without a vacuum. Continuous or discrete amounts of the liquid cryogen 288 from line 266 can also be introduced into working chamber 202.

For most materials, the treating time when the cryogen is nitrogen will vary from 6–24 hours. The time is predetermined, and will depend upon the enthalpy-entropy characteristics of the material and the working chamber 202, which in turn depend upon the total mass and specific heat of the material and on the inner volume of working chamber 202.

A first method for cooling material in working chamber 202 comprises introducing discreet amounts of cryogen vapor 290 into chamber 202, which is not evacuated, by sequentially opening valves 246 and 262. Valve 262 is closed either after a specific time period or when the pressure in storage tank 206 is reduced by a discrete amount, while valve 246 remains open. Thus, a discrete volume of cryogen vapor 290 flows into vapor reservoir 204, and from there into working chamber 202. Valve 246 is closed when the interior of working chamber 202 and the material being treated are reduced to the minimum possible temperature level by the discrete volume of cryogen vapor 290 from vapor reservoir 204. Pressure release valve 278 of vapor reservoir 204 is then opened until the pressure in vapor reservoir 204 returns to a specific pressure of at least one atmosphere; valve 278 is then closed. These steps are repeated until the desired cryogenic temperature level is obtained.

A second method for cooling material in working chamber 202, which is not evacuated, comprises introducing continuous amounts of cryogen vapor 290 into working chamber 202 by sequencially opening valves 246 and 262, allowing the continuous flow of a cryogen vapor 290 from storage tank 206 to working chamber 202 by way of vapor reservoir 204. Valves 246 and 262 can be adjusted to allow either a high or low flow rate, depending upon the desired temperature reduction rate. The temperature reduction rate will depend on the thermal-fracture and distortion threshholds of the material being treated and of the inside wall 202*a* of working chamber 202. The minimum temperature which can be reached in working chamber 202 is limited by the temperature of the cryogen vapor 290, which in turn depends upon the pressure of the cryogen vapor 290. Since the pressure will be higher than one atmosphere in both the first and the second methods, the lowest possible temperature will be greater than the boiling point of the cryogen at one atmosphere.

A third method for cooling material in working chamber 202 comprises the same steps as the first method, except that working chamber 202 is evacuated to a specific initial negative pressure prior to opening valves 246 and 262. Evacuation of working chamber 202 is achieved by operation of vacuum pump 208 and opening valve 252 in line 248 until the desired negative pressure is reached, then closing valve 252. Either a high or low negative pressure can be used before introduction of cryogen vapor 290 into working chamber 202.

In a fourth method, pump 208 is operated and valves 252, 246 and 262 are opened simultaneously and adjusted to provide constant rates of vapor flow from storage tank 206 to working chamber 202 by way of vapor reservoir 204, and continuous evacuation of working chamber 202. A constant rate of flow is achieved by adjusting valves 246 and 252. The negative pressure in working chamber 202 can be high or low, but the evacuation rate must be constant.

A fifth method for cooling the material in working chamber 202 comprises introducing continuous amounts of liquid cryogen 288 into working chamber 202 which has been evacuated to an initial specific negative pressure. Valve 252 is opened and working chamber 202 pumped to a specific negative pressure, then closed. The negative pressure can be either high or low. Valve 268 is then opened until the pressure in working chamber 202 returns to higher specified levels, or until specified temperatures are attained. The process of evacuating working chamber 202 and introducing liquid cryogen 288 is repeated until the desired cryogenic temperature is obtained.

A sixth method for cooling the material in working chamber 202 comprises evacuating working chamber 202 to an initial specific negative pressure and introducing discreet amounts of liquid cryogen 288 into working chamber 202. To achieve this, valve 252 is opened and working chamber 202 is evacuated to a specific negative pressure. The negative pressure can be either high or low. Valve 252 is then closed. Valve 268 is then opened and closed based on either specific pressure reductions in storage tank 206, as shown by pressure indicator 274, or on the temperature level in working chamber 202, as shown by temperature indicator 282.

A seventh method for cooling the material in working chamber 202 comprises the simultaneous continuous introduction of liquid cryogen 288 into working chamber 202 and the evacuation of working chamber 202 to a specific negative pressure. To achieve this, valves 252 and 268 are opened simultaneously. A constant negative pressure in working chamber 202 is maintained by adjusting valves 252 and 268 as required. The negative pressure in working chamber 202 can be either high or low.

Methods three and four can be modified by simultaneously introducing liquid cryogen into working chamber 202 with the cryogen vapor. Likewise, methods five through seven can be modified by simultaneously introducing cryogen vapor into working chamber 202 with the liquid cryogen.

In all of methods three through seven, the minimum temperature that can be reached will be below the boiling point but above the freezing point for the cryogen at one atmosphere. However, the material in working chamber 202 can be cooled to temperatures below the freezing point of the cryogen. This is accomplished by isolating the liquid cryogen 288 in storage tank 206 from the lower temperatures and pressures of working chamber 202 by closing valve 262 when the temperature of working chamber 202 approaches the freezing point of the cryogen. After cryogen vapor 290 from vapor reservoir 204 is introduced into working chamber 202, the reservoir pressure is brought back to higher levels by opening vacuum release valve 264. Valve 264 is then closed before cryogen 290 from storage tank 206 is reintroduced into vapor reservoir 204 at sufficiently high pressures to prevent freezing in storage tank 206. These steps are repeated in conjunction with the steps of methods three through seven until the desired subfreezing temperature is attained.

When the desired temperature level is reached using any of these methods, the temperature level can be maintained by introducing small amounts of cryogen vapor 290 into working chamber 202 by opening and closing valve 246 at periodic intervals while maintaining a vacuum in working chamber 202.

After the material has been treated for the desired length of time at cryogenic temperature levels, the material can be warmed back to room temperature either by introducing warmer external gas (which may be air) into working chamber 202 through vacuum release valve 254 or by heating with radiant heaters 214–220. Warming can take place either in a vacuum or in any desired ambient. During warming, the thermal-fracture and distortion threshholds of the material must not be exceeded.

The material also can be heated to higher-than-room-temperature levels, e.g., for stress-relief heating, by using radiant heating, but again the thermal-fracture and distortion threshholds of the material must not be exceeded during heating. If the material is heated to higher-than-room-temperature either in a vacuum or in warmer external vapors introduced into working chamber 202 through valve 254, the thermal-fracture and distortion rates also must not be exceeded when cooling back to room temperature.

For any embodiment of the invention, the thermal-fracture or distortion threshhold of the material being treated and of the inner volume of the working chamber will predetermine the temperature rate at which the material can be treated. For most materials, this will vary from about 1.0°–18.0° F. per minute. When simultaneously treating different types of materials, the rate must not exceed the lowest of their thermal-fracture or distortion threshholds.

To calculate the temperature reduction of the inner working chamber and contained materials when using nitrogen as the cryogenic fluid, consider the following:

Referring to FIG. 2, assume the following values:

Volume of the Vapor Reservoir $=1\ ft^3=V_1$

Volume of the Working Chamber $=100\ ft^3=V_2$

If nitrogen vapor from storage tank 206 is introduced into vapor reservoir 204 at a pressure of 1 atmosphere the vapor temperature in reservoir 204 is approximately −315° F. or 145° R.

Consider that working chamber 202 is pumped to a pressure of 0.1 atmosphere ($\simeq$0.15 lbs/in$^2$), the pressure at which the reservoir vapor is to be introduced into working chamber 202, then we have for the equation $$T_2=\frac{P_2V_2T_1}{P_1V_1}$$

the following values:

$T_2$=Vapor temperature after expansion to 100 ft$^3$ $T_1\simeq 145°$ R.

$V_1=1\ ft^3$ $V_2=100\ ft^3$ $P_1=1$ atmosphere $P_2=0.1$ atmosphere

Therefore, value for $T_2$ is solved for as follows:

$$T_2\simeq\frac{(0.1\ ATM)\ (100\ ft^3)\ (145°\ R)}{(1.0\ ATM)\ (1\ ft^3)}$$

$T_2\simeq 1450°\ R\simeq 990°$ F.

This is only the calculated temperature for an ideal nitrogen gas and not the actual temperature of nitrogen vapors used in the system; it is, however, an indication of the energy that must be absorbed from inside chamber 202 and contained materials due the volumetric expansion of the nitrogen vapor from 1 ft.$^3$ to 100 ft$^3$ when its pressure is reduced from 1 atmosphere to 0.1 atmosphere.

The temperature reduction of the inner chamber and contained materials may be calculated using the following equation:

$$M_nC_n(T_2-T_1)=M_mC_m(T_r-T_f)$$

where $M_n$=Mass of nitrogen introduced into the chamber from 1 ft$^3$ reservoir.

$C_n$=Specific heat of nitrogen vapor, $T_2$=Calculated final temperature of ideal nitrogen gas $\simeq$1450° R.$\simeq$990° F., $T_1$=Initial temperature of nitrogen vapor $\simeq$145° R.$\simeq$−315° F., $M_m$=Total mass of inner chamber and contained materials, $C_m$=Average specific heats of inner chamber and contained materials, $T_r$=Room temperature $\simeq$70° F., $T_f$=Final temperature of the inner chamber and contained materials.

Therefore, the final temperature, $T_f$, of the inner chamber and contained materials may be calculated by the equation $$T_f=T_r-\frac{C_nM_n}{C_mM_m}(T_2-T_1),\text{ or}$$

$$T_f=70°\ F.-\frac{C_nM_n}{C_mM_m}(1305°\ F.),$$

assuming a room temperature of 70° F. (1305° F. represents the change in temperature from −315° F. to 990° F.). Assume 100 lbs. of iron are to be chilled using 5 lbs. of nitrogen vapor (67 ft$^3$ at 70° F.). Neglecting the mass of the inner chamber, and using the values $C_{Fe}=C_m=0.113$, $C_n=0.2$, the calculated resultant temperature of the iron is −45.5° F.

Thus, the cooling capability of a relatively small amount of nitrogen vapor when introduced into a relatively large volume at low pressure is indicated quite clearly, as is its efficiency.

Figure 4:
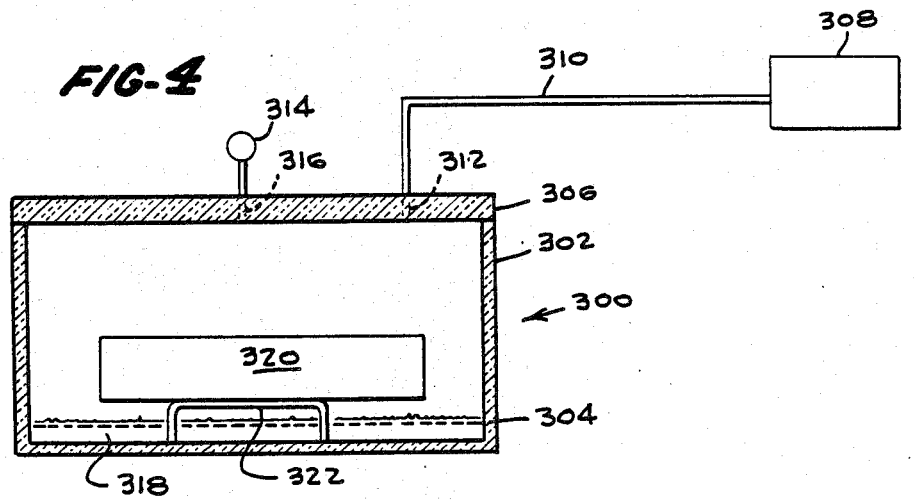
FIG. 4 is a diagramatic view of apparatus used to test the operation of the invention.

Referring now to FIG. 4, there is illustrated simplified apparatus, generally designated by reference numberal 300, used to test the operation of the invention. Apparatus 300 comprises a cryogenic working chamber 302 lined with insulation 304 and having a lid 306, a vacuum pump 308, and a vacuum line 310 connecting working chamber 302 to vaccum pump 308. Vacuum line 310 is inserted into working chamber 302 through a hole 312 in lid 306. A thermometer 314 for monitoring the temperature inside working chamber 302 also is inserted through lid 306, through a hole 316. For purposes of the test, working chamber 302 was constructed of wood. Working chamber 302 was rectangular, and was two feet wide, two feet high, and four long. Polystyrene was used for insulation 304. Working chamber 302 was partially filled to approximately a four-inch depth with liquid nitrogen 318. A seventy-five pound steel block 320, four inches square, was suspended about two inches above the surface of liquid nitrogen 318 by a wire support 322.

By cooling only with nitrogen vapor emanating from liquid nitrogen 318, the temperature of the area immediately above block 320 dropped from about 70° F. to −80° F. in thirty minutes. During this time, the level of liquid nitrogen 318 dropped to approximately three inches.

In a second test, a vacuum of approximately 0.75 atmosphere was attained in working chamber 302 by continuously evacuating it with vacuum pump 308. The temperature directly above the block dropped from approximately 70° F. to −80° F. in twelve minutes. Temperatures lower than −80° F. could not be studied using this apparatus because—at the time—the lowest temperature thermometer 314 could measure was −80° F. However, the apparatus clearly proved that a greater heat absorption rate could be achieved by the nitrogen vapor at reduced pressures.

Because of the large temperature gradient between the liquid-nitrogen surface and the vapor at various levels above the surface, additional tests were conducted using apparatus constructed according to the embodiment of the invention illustrated in FIG. 1. A vapor reservoir 104 was constructed similar to the wooden container used as the working chamber 302 in the apparatus illustrated in FIG. 3. Vapor reservoir 104 was then filled approximately three quarters full (to a depth of about 1.5 feet) with liquid nitrogen. When vacuum pump 106 was turned on, the temperature in working chamber 102 dropped from approximately 70° F. to −80° F. in twenty minutes. The temperature at the bottom of the lid 110 was the same as the temperature in the region directly at the top of the steel block, a distance of eighteen inches. Thus, no vertical temperature gradient existed in that region. The greater time required by the second test apparatus to reach −80° F. is attributed to the larger volume of the two containers, and the fact that the treated area was not directly above the liquid nitrogen. However, this test apparatus was obviously superior to the apparatus illustrated in FIG. 3 because a smaller temperature gradient existed and the temperature reduction rate was more easily controlled by reducing the applied vacuum by partially closing valve 128 to vacuum pump 106.

Thus, it will be seen that all embodiments of the present invention provide a unique method of cooling material to cryogenic temperature levels. While preferred embodiments of the invention have been disclosed, it should be understood that the spirit and scope of the invention is not to be limited solely by the appended claims, since numerous modifications of the disclosed embodiments will undoubtly occur to those of skill in the art.

I claim:

1. A method for cryogenically cooling a material in a chamber comprising the steps of:

generating a cryogen vapor from a liquid cryogen stored in a storage tank at a starting pressure greater than one atmosphere;

introducing a discrete amount of the cryogen vapor into the chamber;

returning the pressure in the storage tank to said starting pressure; and repeating said introducing and returning steps until the material reaches a desired cryogenic temperature.

2. The method of claim 1, wherein said starting pressure is in the range of approximately 40–200 psi.

3. The method of claim 2, wherein the amount of cryogen vapor introduced into the chamber during said introducing step is based on time.

4. The method of claim 2, wherein the amount of cryogenic vapor introduced into the chamber during said introducing step is based on the pressure in the storage tank.

5. The method of claim 2, further comprising evacuating the chamber to a specific negative pressure prior to said introducing step and each repetition thereof.

6. The method of claim 2, said introducing step further comprising introducing a discrete amount of liquid cryogen into the chamber simulatneously with the cryogen vapor.

7. The method of claim 6, wherein the amounts of cryogen vapor and liquid cryogen introduced into the chamber during said introducing step are based on time.

8. The method of claim 6, wherein the amounts of cryogen vapor and liquid cryogen introduced into the chamber during said introducing step are based on the pressure in the storage tank.

9. A method of cryogenically cooling a material in a chamber, comprising:

generating a cryogen vapor from a liquid cryogen stored in a storage tank at a starting pressure of greater than one atmosphere;

storing the cryogen vapor in a vapor reservoir, and continuously introducing the cryogen into the chamber by continuously transferring the cryogen vapor into the chamber from the vapor reservoir until the material reaches a desired cryogenic temperature.

10. The method of claim 9 wherein said starting pressure is in the range of approximately 40–200 p.s.i.

11. A method for cryogenically cooling material in a chamber comprising:

generating a cryogen vapor from a liquid cryogen stored in a storage tank;

storing the cryogen vapor in a vapor reservoir, continuously introducing the cryogen vapor into the chamber at a constant rate until the material reaches the desired cryogenic temperature by continuously transferring the cryogen vapor into the chamber from the vapor reservoir while continuously replenishing the reservoir with cryogen vapor from the storage tank; and continuously evacuating the chamber at a constant rate simultaneously with said introducing step to maintain a negative pressure.

12. The method of claim 11, further comprising the step of introducing liquid cryogen into the chamber simultaneously with the cryogen vapor.

13. The method of claim 12, wherein the amounts of liquid cryogen and cryogen vapor introduced into the chamber during said introducing steps are based on the pressure in the storage tank.

14. The method of claim 12, wherein the amounts of liquid cryogen and cryogen vapor introduced into the chamber during said introducing steps are based on time.

15. The method of claim 11 wherein, once the material reaches the desired cryogenic temperature, the temperature is maintained by the steos of simultaneously re-introducing cryogen vapor into the chamber when the temperature in the chamber rises above a specified level and re-evacuating the chamber.

16. The method of claim 15, further comprising the step of warming the material back to room temperature after the material has been maintained at the desired cryogenic temperature for the desired period of time.

17. The method of claim 16, wherein in said warming step the chamber is evacuated.

18. The method of claim 16, wherein in said warming step, gas warmer than the interior of the chamber is introduced into the chamber.

19. The method of claim 15, further comprising the step of stress-relief heating the material at a temperature in the range of approximately 300°–600° F. using radiant heaters located in the chamber after the material has been maintained at the desired cryogenic temperature for the desired period of time.

20. The method of claim 19, wherein in said stress-relief heating step the chamber is evacuated.

21. The method of claim 19, wherein in said stress-relief heating step, a gas warmer than the interior of the chamber is introduced into the chamber.

22. The method of claim 11, said introducing step further comprising simultaneously continously introducing the liquid cryogen into the chamber at a constant rate.

23. A method for cryogenically cooling a material in a chamber, comprising the steps of:

evacuating the chamber to an initial negative pressure and continuously introducing a liquid cryogen into the chamber at a constant rate until the material reaches the desired cryogenic temperature.

24. A method for cryogenically cooling a material in a chamber, comprising the steps of:

continuously introducing a liquid cryogen into the chamber at a constant rate until the material reaches the desired cryogenic temperature and simultaneously continuously evacuating the chamber at a constant rate.

25. A method for cryogenically cooling a material in a chamber, comprising the steps of:

evacuating the chamber to an initial negative pressure;

introducing a discrete amount of a liquid cryogen into the chamber; and repeating said evacuating and introducing steps until the material reaches the desired cryogenic temperature.

26. The method of claim 23, 25 or 24, further comprising the steps of:

generating a cryogen vapor from the liquid cryogen and introducing cryogen vapor into the chamber simultaneously with the liquid cryogen.

27. The method of claim 26, wherein the amounts of liquid cryogen vapor introduced into the chamber during said introducing steps are based on the pressure in the storage tank.

28. The method of claim 26, wherein the amounts of liquid cryogen and cryogen vapor introduced into the chamber during said introducing steps are based on time.

29. The method of claim 25 wherein, once the material reaches the desired cryogenic temperature, the temperature is maintained by the steps of simultaneously reintroducing cryogen vapor into the chamber when the temperature rises above a specified level and re-evacuating the chamber.

30. The method of claim 29, further comprising the step of warming the material back to room temperature after the material has been maintained at the desired cryogenic temperature for the desired period of time.

31. The method of claim 30, wherein in said warming step, the chamber is evacuated.

32. The method of claim 30, wherein in said warming step, a gas warmer than the interior of the chamber is introduced into the chamber.

33. The method of claim 29, further comprising of stress-relief heating the material at a temperature in the range of approximately 300°-600° F. using radiant heaters located in the chamber after the material has been maintained at the desired cryogenic temperature for the desired period of time.

34. The method of claim 33, wherein in said stress-relief heating step, the chamber is evacuated.

35. The method of claim 33, wherein in said stress-relief heating step, a warmer heating gas is introduced into the chamber.

36. The method of claim 25, wherein the liquid cryogen is stored in a storage tank and the amount of liquid cryogen introduced into the chamber during said introducing step is based on the pressure in the storage tank.

37. The method of claim 25, wherein the amount of liquid cryogen introduced into the chamber during said introducing step is based on time.

38. The method of claim 25, wherein the amount of liquid cryogen introduced into the chamber during said introducing step is based on the pressure in the chamber.

39. The method of claim 25, wherein the amounts of liquid cryogen and cryogen vapor introduced into the chamber during said introducing steps are based on the pressure in the chamber.

40. A method of cryogenically treating materials with a cryogenic fluid at temperature levels as low as the boiling point of the cryogenic fluid at standard temperature and pressure using apparatus comprising a storage tank for storing a liquified cryogenic fluid, a vapor reservoir in fluid communication with the storage tank for holding vapor emanating from the liquified cryogenic fluid, the vapor reservoir having a pressure release valve adjustable between an opened and a closed position, a first valve adjustable between an open and a closed position for controlling fluid flow between the storage tank and the vapor reservoir, a working chamber in fluid communication with the storage tank and the vapor reservoir for holding the material to be treated, a second valve adjustable between an opened and a closed position for controlling fluid flow between the vapor reservoir and the working chamber, and a vacuum pump in fluid communication with the working chamber for evacuating the working chamber, said method comprising the steps of:

1. Filling the storage tank with a liquified cryogenic fluid at a pressure between approximately 40–200 psi;
2. Loading the material to be treated into the working chamber;
3. Opening the first valve;
4. Opening the second valve;
5 Closing the first and third valves when the temperatures of the working chamber and the material being treated are reduced to a minimum level;
6. Opening the pressure release valve of the vapor reservoir;
7. Closing the pressure release valve of the vapor reservoir when the pressure in the vapor reservoir returns to a specific pressure level of at least one atmosphere;
8. Repeating steps 3–7 until the desired cryogenic temperature is reached; and
9. Increasing the pressure in the working chamber by introducing a gas.

41. A method of cryogenically treating materials with a cryogenic fluid at temperature levels as low as the boiling point of the cryogenic fluid at standard temperature and pressure using apparatus comprising a storage tank for storing a liquified cryogenic fluid, a vapor reservoir in fluid communication with the storage tank for holding vapor emanating from the liquified cryogenic fluid, a working chamber in fluid communication with the storage tank and the vapor reservoir for holding the material to be treated, and a vacuum pump in fluid communication with the working chamber for evacuating the working chamber, said method comprising the steps of;

filling the storage tank with a liquified cryogenic fluid at a pressure between approximately 40-200 psi;

loading the material to be treated into the working chamber;

introducing vapor from the storage tank into the vapor reservoir and vapor from the vapor reservoir into the working chamber until the temperatures of the working chamber and the material being treated are reduced to a minimum level;

reducing the pressure in the vapor reservoir to a specific pressure level of at least one atmosphere; and repeating said introducing and reducing steps until the desired cryogenic temperature is reached.

42. A method of cryogenically treating materials with a cryogenic fluid at temperature levels as low as the boiling point of the cryogenic fluid at standard temperature and pressure using apparatus comprising a storage tank for storing a liquified cryogenic fluid, a vapor reservoir in fluid communication with the storage tank for holding vapor emanating from the liquified cryogenic fluid, the vapor reservoir having a pressure release valve adjustable between an open and a closed position, a first valve adjustable between an open an a closed position for controlling fluid flow between the storage tank and the vapor reservoir, a working chamber in fluid communication with the storage tank and the vapor reservoir for holding the material to be treated, a second valve adjustable between an open and a closed position for controlling fluid flow between the vapor reservoir and the working chamber, and a vacuum pump in fluid communication with the working chamber for evacuating the working chamber, said method comprising the steps of:

filling the storage tank with a liquified cryogenic fluid at a pressure between approximately 40-200 psi;

loading the material to be treated into the working chamber;

opening the first valve; and opening the third valve to allow a continuous flow of vapor from the storage to the working chamber via the reservoir, the rate of flow of the vapor depending on the thermal-fracture threshholds of the material being treated and of the working chamber.

43. A method of cryogenically treating materials with a cryogenic fluid at temperature levels between the boiling and freezing points of the cryogenic fluid, using apparatus comprising a storage tank for storing a liquified cryogenic fluid, a working chamber in fluid communication with the storage tank, and a vacuum pump in fluid communication wlth the working chamber, said method comprising the steps of:

evacuating the working chamber to a specific negative pressure and introducing liquid cryogen from the storage tank into the working chamber.

44. The method of claim 43, wherein in said introducing step, the liquid cryogen is introduced into the working chamber in discrete amounts.

45. The method of claim 44, wherein the liquid cryogen is introduced into the working chamber until the pressure in the storage tank has been reduced by a specific amount.

46. The method of claim 44, wherein the liquid cryogen is introduced into the working chamber until the temperature in the working chamber reaches a specific level.

47. The method of claim 43, wherein in said introducing step, the liquid cryogen is introduced continuously into the working chamber.

48. The method of claim 47, wherein the liquid cryogen is introduced into the working chamber until the working chamber pressure increases back to a specific pressure level of at least one atmosphere, and further comprising:

repeating said evacuating and introducing steps until the desired cryogenic temperature is reached.

* * * * *